US009022242B2

(12) United States Patent
Meijers et al.

(10) Patent No.: US 9,022,242 B2
(45) Date of Patent: May 5, 2015

(54) COLLAPSIBLE CONTAINER, ASSEMBLY MECHANISM AND METHOD OF ASSEMBLING A COLLAPSIBLE CONTAINER

(75) Inventors: Arthur Vincent Marius Meijers, Rotterdam (NL); Robert Anthonius Buskermolen, Amsterdam (NL)

(73) Assignee: Holland Container Innovations B.V., Delft (NL)

( * ) Notice: Subject to any disclaimer, the term of this patent is extended or adjusted under 35 U.S.C. 154(b) by 0 days.

(21) Appl. No.: 13/881,005

(22) PCT Filed: Oct. 18, 2011

(86) PCT No.: PCT/NL2011/050711
§ 371 (c)(1),
(2), (4) Date: Jul. 1, 2013

(87) PCT Pub. No.: WO2012/057616
PCT Pub. Date: May 3, 2012

(65) Prior Publication Data

US 2014/0144920 A1 May 29, 2014

(30) Foreign Application Priority Data

Oct. 25, 2010 (CN) ..... 2010 1 0518319
Oct. 26, 2010 (NL) ..... 2005572

(51) Int. Cl.
*B65D 25/28* (2006.01)
*B65D 6/18* (2006.01)
(Continued)

(52) U.S. Cl.
CPC ..... *B65D 21/086* (2013.01); *Y10T 29/49826* (2015.01); *B65D 88/52* (2013.01)

(58) Field of Classification Search
USPC ..... 220/6, 756, 763, 765, 766
See application file for complete search history.

(56) References Cited

U.S. PATENT DOCUMENTS 1,623,409 A * 4/1927 Hempen et al. ..... 220/757
2,736,455 A * 2/1956 Rosen ..... 220/521
(Continued)

FOREIGN PATENT DOCUMENTS

CN 201545684 U 8/2010
GB 2170185 A 7/1986
(Continued)

OTHER PUBLICATIONS

PCT/NL2011/050711 Notification Concerning Transmittal of International Preliminary Report on Patentability dated May 10, 2013 (8 pages).
(Continued)

*Primary Examiner* — Mickey Yu
*Assistant Examiner* — Niki Eloshway
(74) *Attorney, Agent, or Firm* — Edmonds & Nolte, PC

(57) ABSTRACT

A collapsible container comprising at least one wall (2,102, 202,302) which is rotatable about an axis of rotation (A); and an assembly mechanism (6,106,206,306) associated with the wall, the assembly mechanism comprising a lever arm (8,108, 208,308) pivotally connected to the wall at a first location, and a connecting member (10,110,210,310), operable to transmit force applied at the lever arm to the wall at a second location and wherein a first end (16,116,216,316) of the connecting member is operatively connected to the lever arm and a second end (18,118,218,318) of the connecting member is operatively connected to the wall at the second location. Also described is an assembly mechanism for use with such a container.

20 Claims, 5 Drawing Sheets

(51) Int. Cl.

| | |
|---|---|
| ***B65D 21/08*** | (2006.01) |
| ***B65D 88/52*** | (2006.01) |
| *B65D 25/20* | (2006.01) |

(56) References Cited

U.S. PATENT DOCUMENTS

| | | | | |
|---|---|---|---|---|
| 2,829,705 | A * | 4/1958 | Godshalk et al. | 297/2 |
| 3,000,536 | A * | 9/1961 | Roy | 220/741 |
| 3,359,946 | A * | 12/1967 | Schluttig | 119/497 |
| 4,585,134 | A * | 4/1986 | Miyaji et al. | 215/398 |
| 4,646,928 | A | 3/1987 | Ono et al. | |
| 5,469,986 | A * | 11/1995 | Jang | 220/762 |
| 5,566,031 | A | 10/1996 | Meyr et al. | |
| 5,992,664 | A * | 11/1999 | Trapp et al. | 220/6 |
| 6,007,031 | A * | 12/1999 | Tang | 248/96 |
| 6,415,938 | B1 * | 7/2002 | Karpisek | 220/1.5 |
| 7,281,637 | B2 * | 10/2007 | Hadar | 220/6 |
| 7,861,878 | B2 * | 1/2011 | Escarpa Gil | 220/7 |
| 2011/0253732 | A1 * | 10/2011 | Tan | 220/756 |

FOREIGN PATENT DOCUMENTS

| | | | |
|---|---|---|---|
| GB | 2286821 | A | 8/1995 |
| JP | 61093431 | U | 6/1986 |
| WO | 9530586 | A1 | 11/1995 |

OTHER PUBLICATIONS

NL 2011050711 Search Report dated Jan. 17, 2012 (3 pages).

Application No. 201010518319.5—Notification of the First Chinese Office Action dated Sep. 2, 2013, 8 pages. (English Translation Included).

Application No. 201010518319.5—Notification of the Third Chinese Office Action, dated Aug. 20, 2014, 6 pages. (English Translation Included).

* cited by examiner

COLLAPSIBLE CONTAINER, ASSEMBLY MECHANISM AND METHOD OF ASSEMBLING A COLLAPSIBLE CONTAINER

This application is a United States national phase application of co-pending international patent application number PCT/NL2011/050711, filed Oct. 18, 2011, which claims the benefit of the filing date of CN patent application number 201010518319.5, filed Oct. 25, 2010 and NL patent application number 2005572, filed Oct. 26, 2010, the disclosures of which are incorporated herein by reference to the extent consistent with the present disclosure.

The present invention relates to a collapsible container having an assembly mechanism and also to assembly mechanisms for such collapsible containers.

BACKGROUND

Containers of the type disclosed in NL1017159 and U.S. Pat. No. 4,099,640 are employed across the globe for the transport of freight goods, by land, sea and air. Global trade and distribution imbalances frequently necessitate the transport of empty containers from large consumption markets to regions of mass production and manufacture. In order to alleviate the cost of burden of transporting empty containers, collapsible containers have been developed. These containers can be folded when empty into a collapsed, or stowed condition in which they occupy significantly less volume than in their assembled state, thus allowing for more efficient transportation of the containers when empty.

Assembly and disassembly of collapsible containers must take place in a safe and reliable manner. Frequently, the size and weight of the container walls are such that heavy lifting equipment such as forklifts must be employed, complicating operation and increasing the burden of assembly/disassembly. Systems have been developed in which the self weight of large collapsible container walls can be balanced by biasing elements, to facilitate manual assembly and control. An example of such a system is disclosed in EP2036835. However, even with such biasing systems in place, it remains a requirement that an operator be inside the container in order to assemble the walls. This is undesirable form a health and safety point of view, as well as imposing an additional complication on the assembly process.

SUMMARY OF INVENTION

According to the present invention, there is provided a collapsible container comprising:

at least one wall which is rotatable about an axis of rotation; and an assembly mechanism associated with the wall, the assembly mechanism comprising a lever arm pivotally connected to the wall at a first location, and a connecting member, operable to transmit force applied at the lever arm to the wall at a second location and wherein a first end of the connecting member is operatively connected to the lever arm and a second end of the connecting member is operatively connected to the wall at the second location.

The second location, at which force applied to the lever arm is transmitted to the wall via the connecting member, may be distant from the axis of rotation of the wall, thus providing mechanical advantage.

The assembly mechanism may further comprise a housing, via which one of the first and second ends of the connecting member is operatively connected either to the lever arm or to the wall.

The housing may comprise a channel within which the first or second end of the connecting member may be slidingly retained, thus allowing movement of the mechanism from, for example, a stowed position to a deployed position.

The first or second end of the connecting member may be both slidingly and pivotally retained within the channel.

The housing may further comprise a biasing element, which may be operable to bias the first or second end of the connecting member towards a stowed position. The biasing element may be a spring, for example a disc spring or a compression spring. Examples of a collapsible container having a disc spring as the biasing element is described in DE3317221.

The housing may further comprise a stop, against which the first or second end of the connecting member may abuts when the assembly mechanism is in a deployed position.

The other of the first and second ends of the connecting member may be pivotally connected to the other of the lever arm or the wall.

The connecting member comprises a substantially rigid rod.

The connecting member may comprise a hinged rod, the hinge defining two sections, a first section having a first end and a second section having a second end.

The first end of the hinged rod may be pivotally connected to the lever arm and the second end of the hinged rod may be pivotally connected to the wall at the second location.

The connecting member may comprise a cable, which may have elastic properties.

A first end of the elastic cable may be fixedly connected to the lever arm and a second end of the elastic cable may be pivotally connected to the wall at the second location.

The wall of the collapsible container may comprise at least one corrugation and the assembly mechanism may be substantially housed within the corrugation.

The collapsible container may further comprise a biasing mechanism operable to balance the self weight of the wall.

The biasing mechanism may comprise a torsion bar which may be mounted within or adjacent a hinge at the axis of rotation of the wall.

The collapsible container may be a goods transport container.

According to another aspect of the present invention, there is provided an assembly mechanism suitable for use with a collapsible container of the first aspect of the present invention.

According to another aspect of the present invention, there is provided an assembly mechanism for attachment to a wall of a collapsible container, the assembly mechanism comprising a lever arm, operable for pivoting attachment to a wall of a collapsible container at a first location, and a connecting member, operable in use to transmit force applied at the lever arm to the wall of the collapsible container at a second location.

According to another aspect of the present invention, there is provided a method of assembling a collapsible container, the container comprising at least one wall which is rotatable about an axis of rotation and an assembly mechanism associated with the wall, the method comprising:

imparting a raising force to the assembly mechanism at a first location, spaced from the wall; and transmitting the raising force via the assembly mechanism to the wall at a second location, the second location being spaced from the axis of rotation such that a turning moment is imparted to the wall.

The method may further comprise balancing the self weight of the wall during the assembly process.

The self weight of the wall may be balanced via a biasing mechanism.

BRIEF DESCRIPTION OF DRAWINGS

For a better understanding of the present invention, and to show more clearly how it may be carried into effect, reference will now be made, by way of example, to the following drawings, in which.

DETAILED DESCRIPTION OF EMBODIMENTS

With reference to FIGS. 1*a* to 1*g*, a collapsible container comprises at least one wall 2 that is rotatable about an axis of rotation A. It will be appreciated that the container will further comprise additional walls, a base and a roof although these features are omitted from the Figures for clarity. The axis of rotation A of the wall 2 is defined by a pivoting mechanism that is substantially coincident with a lower edge of the wall 2 and may for example comprise a hinge 4.

The container of which the wall 2 forms a part comprises a substantially rectangular shaped bottom and corresponding top as well as end walls and elongated side walls, the length of the side walls being grater than the width of the end walls. The container may be assembled and disassembled substantially as described in NL1017159. The present invention is concerned with the manner in which each wall 2 of the container may be individually raised or lowered. The invention is particularly concerned with the raising and lowering of the elongated side walls.

Figure 1B:
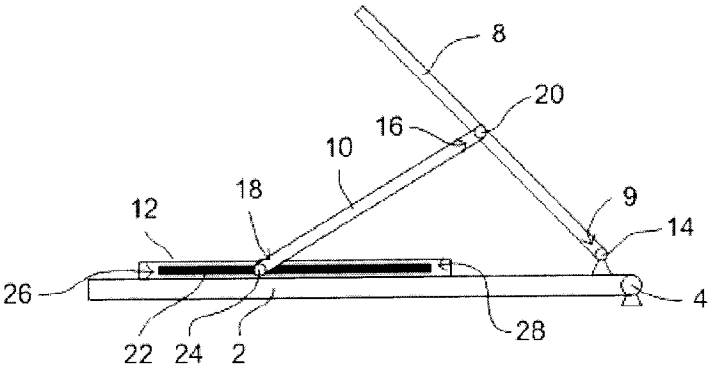
FIGS. 1*a* to 1*g* are side views of a wall of a collapsible container having an assembly mechanism, the views illustrating the container wall in transition from a stowed position (FIG. 1*a*) to a deployed position (FIG. 1*g*).
Figure 1D:
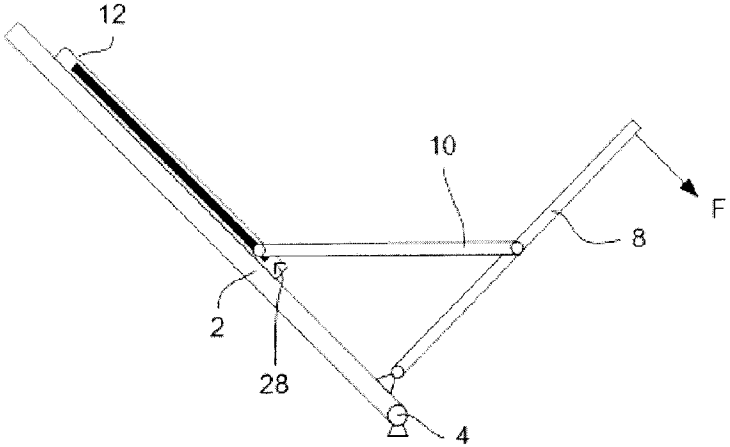
Figure 1A:
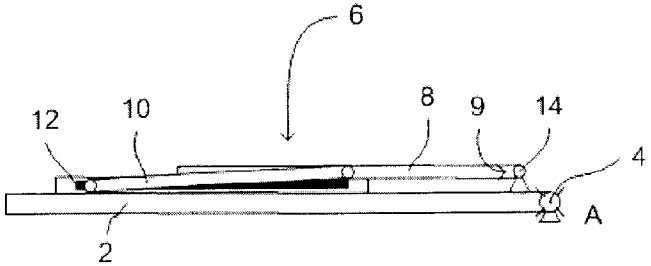

The wall 2 carries an associated assembly mechanism 6 which comprises a lever arm 8, a connecting member 10 and a housing 12. Although a single assembly mechanism is described and illustrated in detail, up to three assembly mechanisms 6 may be used on a single elongated side wall of a container. The lever arm 8 of the assembly mechanism 6 comprises a rigid rod which may for example be made of a metal such as steel. A first end 9 of the lever arm 8 is pivotally connected to the wall 2 via a hinge 14. The hinge 14 is at a first location on the wall 2 which is in close proximity to the lower edge of the wall 2 and the hinge 4 about which the wall 2 rotates. In a stowed position of the assembly mechanism 6, as illustrated in FIG. 1*a*, the assembly mechanism 6 extends along the wall 2 in the direction of an assembly axis that is substantially perpendicular to the axis of rotation of the wall 2. The hinge 14 between the lever arm 8 and the wall 2 permits pivoting motion of the lever arm within a plane defined by the assembly axis.

The connecting member 10 of the assembly mechanism 6 comprises a substantially rigid rod having a first end 16 and a second end 18. The first end 16 of the connecting member 10 is pivotally connected to the lever arm 8 via a hinge 20 at a position approximately mid way along the length of the lever arm 8. The second end 18 of the connecting member 10 is slidably and pivotally received within the housing 12. The housing 12 is fixedly connected to the wall 2 at a second location that is distant from the first location at which the lever arm 8 is pivotally connected to the wall 2. The housing 12 comprises a channel or rail 22, along which a slider 24, located at the second end 18 of the connecting member 10, may slide. The channel 22 comprises first and second end stops 26, 28 that limit the motion of the slider 24 at the extreme ends of the channel 22.

Figure 1C:
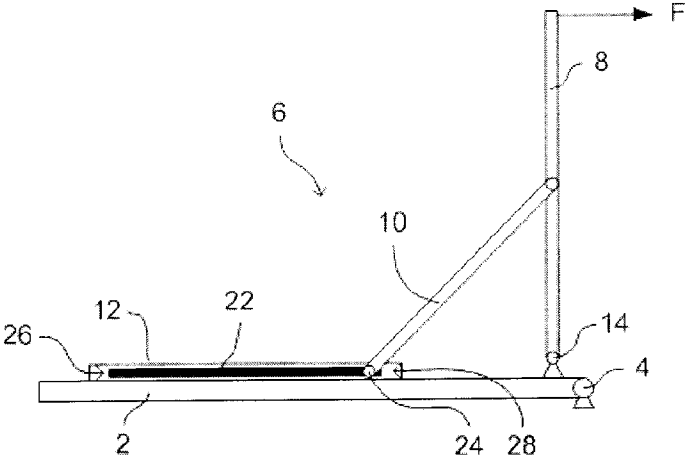

FIG. 1*a* illustrates the rotatable container wall 2 in a stowed position, with the assembly mechanism 6 also in a stowed position. In the stowed position of the assembly mechanism 6, both the lever arm 8 and the connecting member 10 are substantially aligned with the wall 2, with the slider 24 at or adjacent the first end stop 26. In order to deploy the assembly mechanism, the lever arm 8 is raised, pivoting at its first end 9 about the hinge 14. As the lever arm 8 is raised, the connecting member 10 pivots at its first and second ends 16, 18, and the slider 24 slides in the channel 22 towards the first end 9 of the lever arm 8. At the fully deployed position of the assembly mechanism 6, the slider 24 abuts the second end stop 28 of the channel 22, preventing further pivoting of the lever arm 8 away from the wall 2. This position is illustrated in FIG. 1*c*.

With the assembly mechanism 6 in the fully deployed position, further force applied to the lever arm 8 away from the wall 2 (the direction F illustrated in FIG. 1*c*) causes rotation of the wall 2 towards a deployed position. Force applied to the lever arm 8 is transmitted via the connecting member 10, slider 24, end stop 28 and housing 12 to the wall 2. It will be appreciated that the force is applied to the wall at a location that is remote from the axis of rotation A of the wall 2, and so creates a turning moment. FIG. 1*d* illustrates the wall 2 in transition, force F continuing to be applied, and FIG. 1*e* illustrates the wall 2 in a deployed state.

Figure 1G:
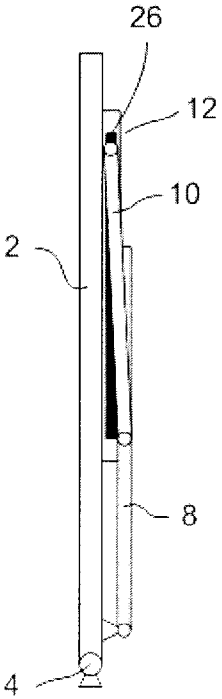
Figure 1F:
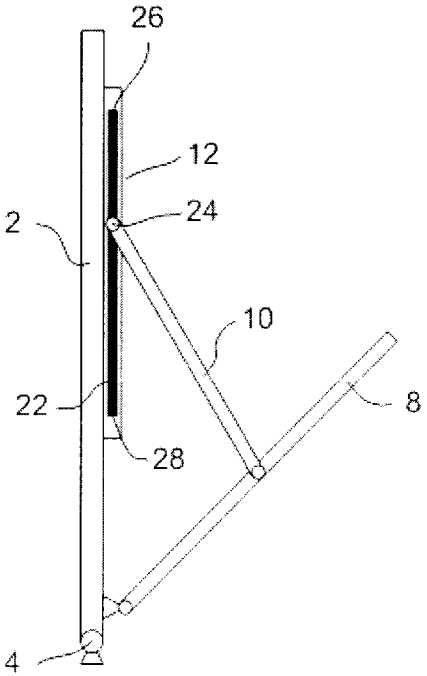
Figure 1E:
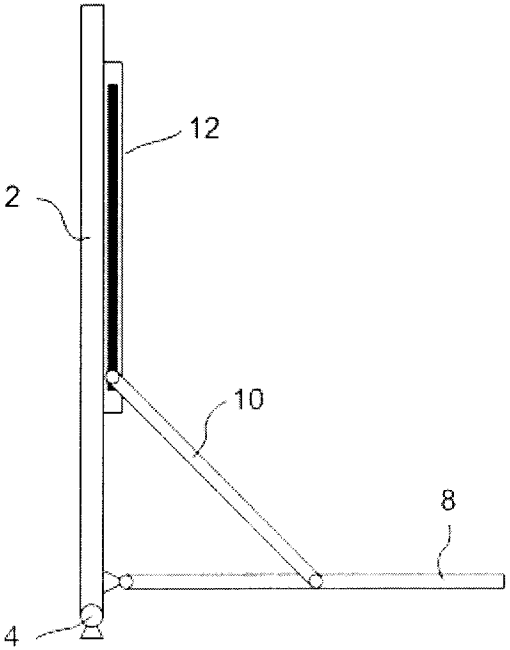

Once the wall 2 has been deployed, the assembly mechanism 6 can be returned to its stowed position by allowing the connecting member 10 and lever arm 8 to pivot back to their stowed positions, as illustrated in FIG. 1*g*. The slider 24 slides along the channel 22 as illustrated in FIG. 1*f* back to a position adjacent the first end stop 26, at which point the connecting member 10 and lever arm 8 are again substantially aligned with the wall 2, as shown in FIG. 1*g*.

It will be appreciated that the greater the distance between the location at which the force F applied to the lever arm 8 is transmitted to the wall 2 and the axis of rotation A of the wall 2, the greater the turning moment applied to the wall 2. For this reason, the assembly mechanism 6 is dimensioned to occupy substantially the entire height of the wall 2, with the farthest extent of the housing 12 being near to an upper edge of the wall 2.

It is known for container walls to include corrugations or other indents that may extend along a dimension of the wall. According to one embodiment of the present invention, the assembly mechanism is housed within such a corrugation or indent, such that in the stowed position, the assembly mechanism does not protrude outwards past the corrugation or indent. In this manner, the assembly mechanism is protected from accidental damage during use or transport of the container, and the outside profile of the container wall is unchanged both when in the stowed and when in the deployed positions.

Figure 2:
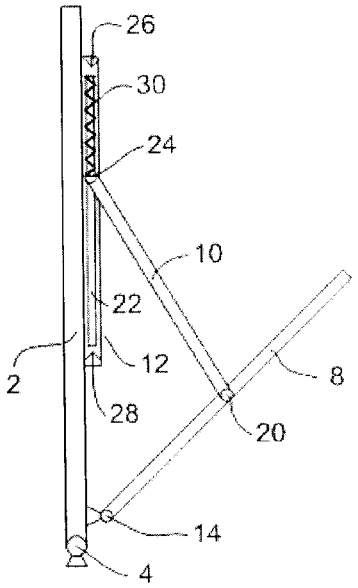
FIG. 2 illustrates a variation of the assembly mechanism shown in FIG. 1.

With reference to FIG. 2, a biasing element in the form of a spring 30 may be incorporated into the channel 22 in the housing 12 of the assembly mechanism 6. The spring 30 is housed completely within the channel 22 and acts to bias the slider 24 towards the first end stop 26 of the housing 12, and hence to bias the assembly mechanism 6 towards the stowed position. The spring 30 thus maintains the assembly mechanism 6 in the stowed position when the assembly mechanism is not in use. The spring 30 additionally urges the assembly mechanism 6 to return to the stowed position after use.

Figure 3:
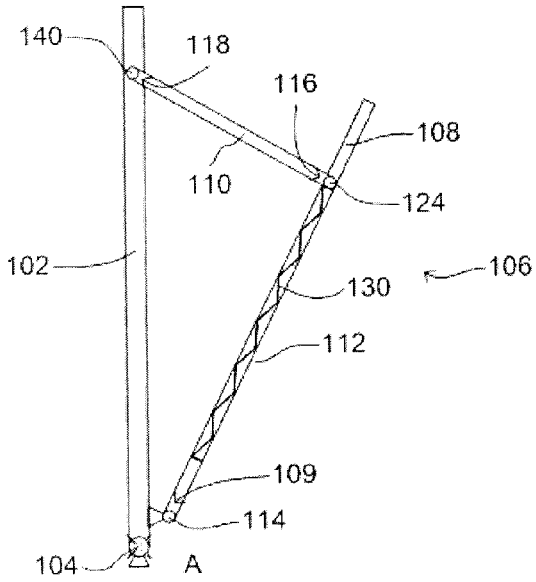
FIG. 3 illustrates an alternative embodiment of assembly mechanism.

FIG. 3 shows an alternative embodiment of container incorporating a wall 102 and assembly mechanism 106. The wall 102 pivots about an axis A at a hinge 104. The assembly mechanism 106 comprises a lever arm 108, a connecting member 110 and a housing 112. A first end 109 of the lever arm 108 is pivotally connected to the wall 102 via a hinge 114. As in the previously described embodiment, the hinge 114 is at a first location on the wall 102 which is in close proximity to the lower edge of the wall 102 and the hinge 104 about which the wall 102 rotates. In a stowed position of the assembly mechanism 106, the assembly mechanism 106 extends along the wall 102 in the direction of an assembly axis that is substantially perpendicular to the axis of rotation of the wall 102. The hinge 114 between the lever arm 108 and the wall 102 permits pivoting motion of the lever arm within a plane defined by the assembly axis.

The connecting member 110 of the assembly mechanism 106 again comprises a substantially rigid rod having a first end 116 and a second end 118. According to the embodiment shown in FIG. 3, the first end 116 of the connecting member 110 is slidably and pivotally received in the housing 112, which is fixedly connected to the lever arm 108. Alternatively the housing 112 may be formed integrally with the lever arm 108 as a component part of the lever arm 108. The housing 112 comprises a channel 122 (not shown) within which a slider 124 formed on the first end of the connecting member 110 may slide. An end stop (not shown) may be formed within the housing 112 or on the lever arm 108 to prevent movement of the slider past a desired fixed point. A biasing element in the form of a spring 130 is housed within the housing 112 and biases the slider 124 towards the first end 109 of the lever arm 108. The second end 118 of the connecting member 110 is pivotally connected to the wall 102 via a hinge 140 at a second location on the wall 102 that is distant from the first location. As in the previously described embodiment, the assembly mechanism is moveable from a stowed position, in which the lever arm 108 and connecting element 110 are substantially aligned with the wall 102, to a deployed position, in which force applied to the lever arm 108 is transferred to the wall 102 via the connecting element 110. The force exerts a turning moment via the assembly mechanism 106, acting to rotate the wall 102 to its deployed position. The spring 130 acts to bias the assembly mechanism 106 to the stowed position when the assembly mechanism 106 is not in use.

Figure 4:
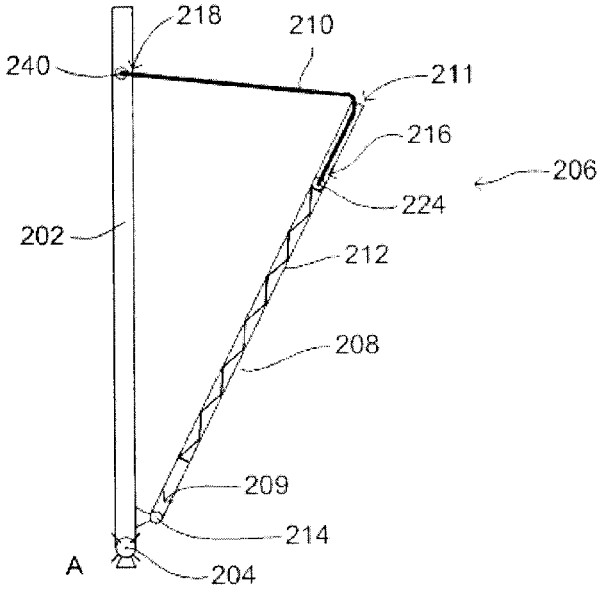
FIG. 4 illustrates another alternative embodiment of assembly mechanism.

FIG. 4 illustrates another alternative embodiment of container comprising a wall 202 and assembly mechanism 206. The wall 202 pivots about an axis A at a hinge 204. The assembly mechanism 206 comprises a lever arm 208, a connecting member 210 and a housing 212. A first end 209 of the lever arm 208 is pivotally connected to the wall 202 via a hinge 214. As in the previously described embodiments, the hinge 214 is at a first location on the wall 202 which is in close proximity to the lower edge of the wall 202 and the hinge 204 about which the wall 202 rotates. In a stowed position of the assembly mechanism 206, the assembly mechanism 206 extends along the wall 202 in the direction of an assembly axis that is substantially perpendicular to the axis of rotation of the wall 202. The hinge 214 between the lever arm 208 and the wall 202 permits pivoting motion of the lever arm within a plane defined by the assembly axis.

The connecting member 210 comprises a flexible cable having a first end 216 and a second end 218. The first end 216 of the connecting cable 210 passes over a free end 211 of the lever arm 208 and is slidably received in the housing 212, which is fixedly connected to the lever arm 208. Alternatively the housing 212 may be formed integrally with the lever arm 208 as a component part of the lever arm 208. The housing 212 comprises a channel 222 (not shown) within which a slider 224 formed on the first end 216 of the connecting member 210 may slide. An end stop (not shown) may be form within the housing 212 or on the lever arm 208 to prevent movement of the slider past a desired fixed point, for example to prevent the slider 224 exiting the housing 212 and thus passing out of the free end 211 of the lever arm 208. A biasing element in the form of a spring 230 is housed within the housing 212 and biases the slider 224 towards the first end 209 of the lever arm 208. The second end 218 of the connecting cable 110 is pivotally connected to the wall 202 via a hinge 240 at a second location on the wall 202 that is distant from the first location. As in the previously described embodiments, the assembly mechanism is moveable from a stowed position, in which the lever arm 208 and connecting cable 210 are substantially aligned with the wall 202 (the connecting cable 210 being substantially completely received within the housing 212 on the lever arm 208), to a deployed position, in which force applied to the lever arm 208 is transferred to the wall 202 via the connecting cable 210. The force exerts a turning moment via the assembly mechanism 206, acting to rotate the wall 202 to its deployed position. The spring 230 acts to bias the assembly mechanism 206 to the stowed position when the assembly mechanism 206 is not in use.

In an alternative embodiment, (not shown) the connecting cable 210 may be a resilient cable having elastic properties. In this case, the assembly mechanism 206 does not include a spring 230 or slider 224, and the first end 216 of the connecting cable 210 is fixedly connected to an end of the housing 212 that is adjacent the first end 209 of the lever arm 208. In this embodiment, extension of the cable under a force enables the assembly mechanism 206 to pivot to a deployed position, the lever arm 208 pivoting about its hinge 214 and the connecting cable 210 extending to allow this motion, the cable 210 passing over the free end 211 of the lever arm 208 to the hinge 240 at which it is pivotally connected to the wall 202. When no longer in use, the elastic properties of the cable 210 act to return the cable 210 to its unstressed length, and hence return the assembly mechanism 206 to its stowed position, with substantially the entirety of the cable 210 received within the housing 212 and hence the lever arm 208 and cable 212 substantially aligned with the wall 202.

Figure 5:
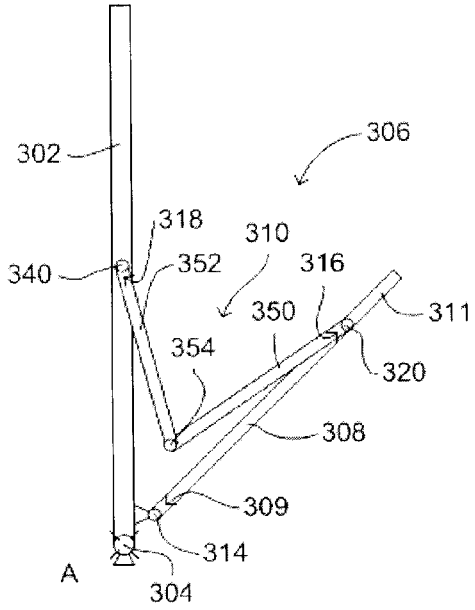
FIG. 5 illustrates another alternative embodiment of assembly mechanism.

With reference to FIG. 5, another alternative embodiment of container comprises a wall 302 and an assembly mechanism 306. The wall 302 pivots about an axis A at a hinge 304. The assembly mechanism 306 comprises a lever arm 308 and a connecting member 310. A first end 309 of the lever arm 308 is pivotally connected to the wall 302 via a hinge 314. As in the previously described embodiments, the hinge 314 is at a first location on the wall 302 which is in close proximity to the lower edge of the wall 302 and the hinge 304 about which the wall 302 rotates. In a stowed position of the assembly mechanism 306, the assembly mechanism 306 extends along the wall 302 in the direction of an assembly axis that is substantially perpendicular to the axis of rotation of the wall 302. The hinge 314 between the lever arm 308 and the wall 302 permits pivoting motion of the lever arm within a plane defined by the assembly axis.

The connecting member 310 comprises a hinged rigid rod having a first section 350 and a second section 352 joined by a hinge 354. The first section 350 comprises a first end 316 that is pivotally connected to the lever arm 308 by a hinge 320. The hinge 320 is located on a region of the lever arm 308 that is close to a free end 311 of the lever arm 308 than to the first end 309 of the lever arm 308. The second section 352 of the connecting element 310 comprises a second end 318 that is pivotally connected to the wall 302 at a hinge 340. The hinge 340 is positioned at a second location on the wall 302 that is distant from the first location. The assembly mechanism 306 is moveable from a stowed position to a deployed position. In the stowed position, the lever arm 308 and first and second sections 350, 352 of the connecting member 310 are all substantially aligned with the wall 302. The hinge 354 between the first and second sections 350, 352 of the connecting member is at its closest approach to the first end 309 of the lever arm 308. In the fully deployed position of the assembly mechanism 306, the lever arm 308 is pivoted away from the wall 302 until the first and second sections 350, 352 of the connecting member 310 are aligned with each other, allowing the maximum separation between the free end 311 of the lever arm 308 and the wall 302. FIG. 5 illustrates the assembly mechanism 306 in transit between the stowed and deployed positions.

It will be appreciated that all of the embodiments of assembly mechanism described above may be housed within a corrugation or indent of a container wall, as described with reference to the first embodiment. Mounting the assembly mechanism within a corrugation or indent protects the assembly mechanism from accidental damage and ensures the outside profile of the container is unaffected by the presence of the assembly mechanism.

It will be further appreciated that, while only a single folding wall of a collapsible container has been described, a collapsible container according to the present invention may have four foldable walls, each being pivotable about at an end and each comprising at least one assembly mechanism as described herein.

While the assembly mechanism may be mounted in any appropriate place on a container wall, collapsible container walls are generally designed to be folded inwards, so as to occupy the minimum volume in the collapsed state. It is therefore envisaged that the assembly mechanism for each container wall be incorporated on an outside face of the wall.

The container of the present invention offers advantages in that folding walls of the container can be easily assembled by a single or a small number of operators. The operator(s) may remain outside the container during the assembly process. The assembly mechanism acts as a handle, transferring a turning moment to the wall in which it is incorporated, enabling the wall to be erected from outside the container. Disassembly of the walls can also be effected in a controlled manner through use of the assembly mechanisms of the present invention.

Figure 6:
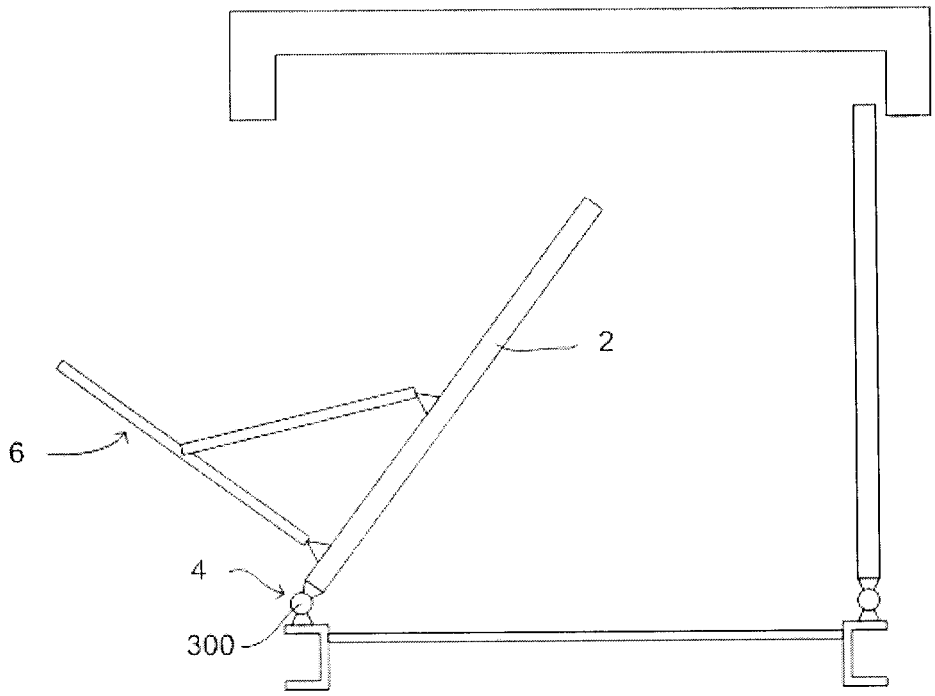
FIG. 6 illustrates a partially assembled wall of a collapsible container, the wall having an assembly mechanism and a biasing mechanism.

The container of the present invention may also incorporate spring balancer systems of a kind known in the art in order to substantially balance the self weight of the container walls, thus reducing the size of the force F that must be applied to the lever arm of an assembly mechanism in order to erect the associated container wall. Such a balancing system is illustrated in FIG. 6, where the wall 2 is shown in a partially deployed position with the assembly mechanism 6 in a fully deployed position. A torsion bar 300 is mounted within the hinge 4 about which the wall pivots. The torsion bar 300 substantially balances the self weight of the wall 2, assisting with manual assembly and disassembly of the wall 2.

While it is envisaged that collapsible containers be provided with assembly mechanisms already formed in the necessary walls, it will also be appreciated that assembly mechanisms according to the present invention may be retrofit onto existing container walls. Assembly mechanism may be manufactured independently and mounted within a suitable corrugation of an existing container wall.

To avoid unnecessary duplication and repetition in the text, certain features of the invention are described only in relation to one or several aspects of embodiments of the invention. However, it is to be understood that, where it is technically possible, features described in relation to any aspect or embodiment of the invention may also be used with any other aspect or embodiment of the invention.

The invention claimed is:

1. A collapsible container comprising:

a substantially rectangular shaped bottom and corresponding top;

a plurality of end walls;

a plurality of elongated side walls, wherein the length of each of the plurality of elongated side walls is greater than the width of each of the plurality of end walls;

at least one of the plurality of elongated side walls rotatable about an axis of rotation defined by a pivoting mechanism that is substantially coincident with a lower edge of the at least one of the plurality of elongated side walls to allow the at least one of the plurality of elongated side walls to be folded inwards; and an assembly mechanism incorporated on an outside face of the at least one of the plurality of elongated side walls comprising:

a lever arm pivotally connected to the at least one of the plurality of elongated side walls at a first location proximate to the lower edge of the at least one of the plurality of elongated side walls; and a connecting member operable to transmit force applied at the lever arm to the at least one of the plurality of elongated side walls at a second location distal to the axis of rotation, wherein a first end of the connecting member is operatively connected to the lever arm and a second end of the connecting member is operatively connected to the at least one of the plurality of elongated side walls at the second location, and the force transmitted to the second location results in the at least one of the plurality of elongated side walls being pivoted about the axis of rotation.

2. The collapsible container of claim 1, wherein the assembly mechanism further comprises a housing operatively connecting the first end or second end of the connecting member to the lever arm or the at least one of the plurality of elongated side walls.

3. The collapsible container of claim 2, wherein the housing comprises a channel slidingly retaining the first end or second end of the connecting member within.

4. The collapsible container of claim 3, wherein the channel pivotally retains the first end or second end of the connecting member within.

5. The collapsible container of claim 2, wherein the housing comprises a biasing element operable to bias the first end or second end of the connecting member toward a stowed position.

6. The collapsible container of claim 2, wherein the housing comprises a stop operable to abut against the first end or second end of the connecting member in a deployed position.

7. The collapsible container of claim 2, wherein the housing pivotally connects the first end or second end of the connecting member to the lever arm or the at least one of the plurality of elongated side walls.

8. The collapsible container of claim 1, wherein the connecting member comprises a substantially rigid rod.

9. The collapsible container of claim 1, wherein the connecting member comprises a hinged rod defining a first section having a first end and a second section having a second end.

10. The collapsible container of claim 9, wherein the first end of the hinged rod is pivotally connected to the lever arm and the second end of the hinged rod is pivotally connected to the at least one of the plurality of elongated side walls at the second location.

11. The collapsible container of claim 1, wherein the connecting member comprises a cable.

12. The collapsible container of claim 11, wherein the cable has elastic properties.

13. The collapsible container of claim 12, wherein a first end of the cable is fixedly connected to the lever arm and a second end of the cable is pivotally connected to the at least one of the plurality of elongated side walls at a second location.

14. The collapsible container of claim 1, wherein the at least one of the plurality of elongated side walls comprises at least one corrugation and the assembly mechanism is substantially housed within the at least one corrugation.

15. The collapsible container of claim 1, further comprising a biasing mechanism operable to balance a weight of the at least one of the plurality of elongated side walls.

16. The collapsible container of claim 15, wherein the biasing mechanism comprises a torsion bar.

17. The collapsible container of claim 16, wherein the torsion bar is mounted within or adjacent a hinge at the axis of rotation of the at least one of the plurality of elongated side walls.

18. A method of assembling a collapsible container comprising:

a substantially rectangular shaped bottom and corresponding top;

a plurality of end walls;

a plurality of elongated side walls, wherein the length of each of the plurality of elongated side walls is greater than the width of each of the plurality of end walls;

at least one of the plurality of elongated side walls rotatable about an axis of rotation defined by a pivoting mechanism that is substantially coincident with a lower edge of the at least one of the plurality of elongated side walls to allow the at least one of the plurality of elongated side walls to be folded inwards; and an assembly mechanism incorporated on an outside face of the at least one of the plurality of elongated side walls, the method comprising:

imparting a raising force to the assembly mechanism at a first location spaced from the at least one of the plurality of elongated side walls; and transmitting the raising force via the assembly mechanism to the at least one of the plurality of elongated side walls at a second location, the second location being spaced from the axis of rotation such that a turning moment is imparted on the at least one of the plurality of elongated side walls, and the transmitted raising force resulting in the at least one of the plurality of elongated side walls being pivoted about the axis of rotation.

19. The method of claim 18, further comprising balancing a weight of the at least one of the plurality of elongated side walls during assembly of the collapsible container.

20. The method of claim 19, wherein the weight of the at least one of the plurality of elongated side walls is balanced via a biasing mechanism.

* * * * *